US006644754B2

(12) United States Patent
Yoshimoto

(10) Patent No.: US 6,644,754 B2
(45) Date of Patent: Nov. 11, 2003

(54) TUNNEL EXCAVATING MACHINE

(75) Inventor: Koichi Yoshimoto, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/160,188

(22) Filed: Jun. 4, 2002

(65) Prior Publication Data

US 2002/0189138 A1 Dec. 19, 2002

(30) Foreign Application Priority Data

Jun. 4, 2001 (JP) ..... 2001-167600
Jun. 4, 2001 (JP) ..... 2001-167601

(51) Int. Cl.[7] ..... E01D 9/08
(52) U.S. Cl. ..... 299/57; 405/138
(58) Field of Search ..... 299/31–33, 55, 299/56, 59, 61, 57; 405/132, 138, 141–143, 288, 290, 53; 175/53, 98, 99, 385

(56) References Cited

U.S. PATENT DOCUMENTS 5,234,257 A * 8/1993 Sugden et al. ..... 299/10
5,931,601 A * 8/1999 Terada et al. ..... 405/138
6,206,478 B1 * 3/2001 Uehara et al. ..... 299/33
6,305,754 B1 * 10/2001 Uehara et al. ..... 299/57
6,382,732 B1 * 5/2002 Tanaka et al. ..... 299/55

* cited by examiner

*Primary Examiner*—Robert E. Pezzuto
(74) *Attorney, Agent, or Firm*—Birch, Stewart, Kolasch & Birch, LLP

(57) ABSTRACT

A tunnel excavating machine having an excavating machine body can be moved forward by shield jacks. A rotatable cutter head is mounted in a front portion of the excavating machine body. An erector device for assembling segments in a ring form is mounted in a rear portion of the excavating machine body. A rest extends rearward from the rear portion of the excavating machine body. A shape retainer for making pressurized contact with inner peripheral surfaces of the assembled segments to retain the segments in a predetermined shape is supported on the rest so as to be movable along a fore-and-aft direction. Also, a revolving frame is located between the erector device and the shape retainer, and supported on the rest so as to be movable along the fore-and-aft direction such that the revolving frame does not interfere with the erector device and the shape retainer. A cage is supported on the revolving frame so as to be revolvable in a circumferential direction of an existing tunnel.

11 Claims, 10 Drawing Sheets

TUNNEL EXCAVATING MACHINE

The entire disclosure of Japanese Patent Application No. 2001-167600 filed on Jun. 4, 2001 and Japanese Patent Application No. 2001-167601 filed on Jun. 4, 2001 including specification, claims, drawings and summary is incorporated herein by reference in its entirety.

BACKGROUND OF THE INVENTION

1. Field of the Invention

This invention relates to a tunnel excavating machine, such as a shield excavator or a tunnel boring machine, for excavating the soil and assembling covering members, such as segments, onto the inner wall surface of the soil to construct a tunnel.

2. Description of Related Art

In a general tunnel excavating machine, a cutter head is rotatably mounted in a front portion of an excavating machine body. Many cutter bits are fixed to the front surface of the cutter head, while a ring gear is fixed to a rear portion of the cutter head, and a drive gear of a drive motor mounted on the excavating machine body is in mesh with the ring gear. A plurality of shield jacks are arranged parallel in a circumferential direction in a rear portion of the excavating machine body. The shield jacks are stretched rearward in an excavating direction and pressed against existing segments, so that the excavating machine body can be moved forward by a reaction force generated thereby.

An erector device is provided in the rear portion of the excavating machine body, and the erector device mounts new segments in a space between the excavating machine body advanced by the shield jacks and the existing segments, and assembles the new segments in a ring shape. Furthermore, a rest extends rearward from the rear portion of the excavating machine body, and the rest is provided with a segment assembly scaffold for bolting the segments assembled by the erector device, and a shape retainer for retaining the ring-shaped segments in a predetermined shape (for example, a round shape).

Thus, when the shield jacks are stretched with the cutter head being rotated, the excavating machine body is advanced by the reaction force resulting from the pushing of the shield jackets against the established segments, whereupon the cutter head excavates the soil lying ahead, forming a tunnel. Then, the erector device assembles segments in a ring form to the inner wall surface of the resulting tunnel. An operator bolts the segments to each other while standing on the segment assembly scaffold, and the shape retainer corrects the ring-shaped segments to a predetermined shape and retains them in this shape.

With the above-described conventional tunnel excavating machine, the erector device and a cage of the segment assembly scaffold move in the circumferential direction within the constructed tunnel. Thus, the erector device and the cage of the segment assembly scaffold are disposed in a displaced manner relative to each other in a fore-and-aft direction in order to prevent their interference with each other. In this case, while the erector device is holding the segments and locating and retaining them at predetermined positions, the operator needs to ride on the cage and move near the segment assembly position, and then carry out an operation for bolting the segments together with the use of a tool. However, the erector device and the cage are displaced from each other in the fore-and-aft direction. Thus, the operator riding on the cage is spaced by a predetermined distance from the bolting site of the segment, having difficulty in performing the bolting operation.

SUMMARY OF THE INVENTION

The present invention has been accomplished in an attempt to solve the above-mentioned problems. Its object is to provide a tunnel excavating machine which increases the efficiency of an assembly operation for a covering member.

According to the present invention, there is provided a tunnel excavating machine, comprising:

- a cylindrical excavating machine body;
- propulsion jacks for moving the cylindrical excavating machine body forward;
- a cutter head rotatably mounted in a front portion of the excavating machine body;
- an erector device mounted in a rear portion of the excavating machine body and adapted to assemble covering members in a ring form onto an inner wall surface of an existing tunnel;
- a rest extending rearward from the rear portion of the excavating machine body;
- a revolving frame located behind the erector device and supported on the rest so as to be movable along a fore-and-aft direction of the existing tunnel such that the revolving frame does not interfere with the erector device; and
- a working platform supported on the revolving frame so as to be revolvable in a circumferential direction of the existing tunnel.

Thus, the working platform can be brought close to the covering members assembled by the erector device. Hence, the operator can easily perform a bolting operation, and the work efficiency of a segment assembly operation can be increased.

In the tunnel excavating machine of the invention, a shape retainer for making pressurized contact with inner peripheral surfaces of the covering members assembled onto the inner wall surface of the existing tunnel to retain the covering members in a predetermined shape may be provided and supported on the rest so as to be movable along the fore-and-aft direction of the existing tunnel, and the revolving frame may be located between the erector device and the shape retainer and supported on the rest so as not to interfere with the erector device and the shape retainer.

Thus, the working platform can be brought close to the covering members assembled by the erector device, without interference of the working platform with the shape retainer. Hence, the operator can easily perform a bolting operation.

The tunnel excavating machine of the invention may further comprise working platform revolving means for moving the working platform to a predetermined revolving position, erector revolving position detection means for detecting a revolving position of the erector device, and working platform control means for setting a working position of the working platform adapted for the revolving position of the erector device and controlling the working platform revolving means.

Thus, the working platform can be brought close to the covering members assembled by the erector device, easily and in a short time, without interference of the working platform with surround instruments. Hence, the operator can easily perform a bolting operation, and the work efficiency of a segment assembly operation can be increased.

In the tunnel excavating machine of the invention, the working position of the working platform may be at a revolving angle from a horizontal reference position, and the revolving angle may be set by adding or subtracting a preset given angle to or from a revolving angle of the erector device from the horizontal reference position.

Thus, the revolving angle of the working platform can be set easily, and the working platform can be moved to the working position easily.

In the tunnel excavating machine of the invention, the given angle may have been set in accordance with the revolving angle of the erector device.

Thus, the working platform can be moved to a position close to the erector device, regardless of the revolving position of the erector device.

In the tunnel excavating machine of the invention, the working platform may be supported in a horizontal state regardless of the revolving position of the working platform, and the working platform control means may set the working position of the working platform, where the erector device and the working platform are close to each other at a constant distance, regardless of the revolving position of the erector device.

Thus, the operator can easily perform a bolting operation, regardless of the revolving position of the erector device.

In the tunnel excavating machine of the invention, the revolving frame may be moved back and forth, whereby the working platform can be moved into and out of a revolving range of the erector device.

Thus, the working platform can be moved close to the erector device, with interference of the erector device and the working platform being prevented.

In the tunnel excavating machine of the invention, the working platform control means may be constituted such that an operation by an operator controls the working platform revolving means to move the working platform to the working position and stop the working platform at the working position.

Thus, operability for moving the working platform can be increased.

In the tunnel excavating machine of the invention, the working platform may have a working step protruding forward.

Thus, the operator can easily move forward with the use of the working step, and carry out a bolting operation for the covering members adjacent in the fore-and-aft direction.

In the tunnel excavating machine of the invention, the working step may be constituted by a front wall portion of the working platform pivoted forward.

Thus, a working space on the working platform can be widened easily with a simple structure.

In the tunnel excavating machine of the invention, the working step may be constituted by a bottom portion and a front wall portion of the working platform sliding forward.

Thus, a working space on the working platform can be widened easily, with sufficient safety of the operation being ensured.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Embodiments of the present invention will now be described in detail with reference to the accompanying drawings, which in no way limit the invention.

[First Embodiment]

Figure 1:
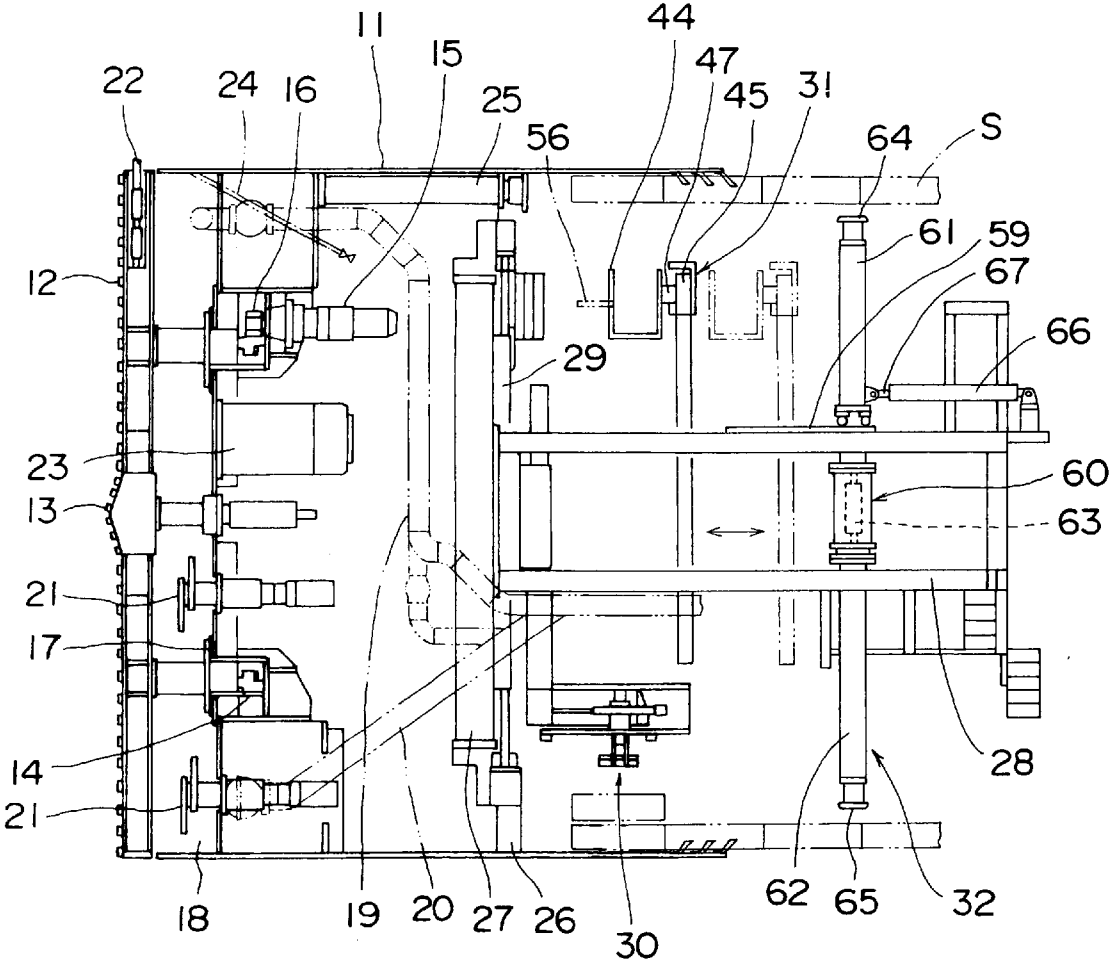
FIG. 1 is a schematic side view of a tunnel excavating machine according to a first embodiment of the present invention.

In a tunnel excavating machine according to the present embodiment, as shown in FIG. 1, a cutter head 12 is rotatably mounted in a front portion of an excavating machine body 11, and many cutter bits 13 are fixed to the front surface of the cutter head 12. A ring gear 14 is fixed to a rear portion of the cutter head 12, while a drive motor 15 is attached to the excavating machine body 11, and a drive gear 16 of the drive motor 15 is in mesh with the ring gear 14. Thus, when the drive motor 15 is driven to rotate the drive gear 16, the cutter head 12 can be rotated via the ring gear 14.

A bulkhead 17 is attached to the excavating machine body 11 behind the cutter head 12, and a chamber 18 is formed between the cutter head 12 and the bulkhead 17. A mud feed pipe 19 and a mud discharge pipe 20, each of whose ends extends to the outside of the shield excavating machine, have the other ends open in the chamber 18. An agitator 21 for agitating and mixing excavated earth and sand and muddy water is installed near the opening of the mud discharge pipe 20. A copy cutter (overbreak cutter) 22 is provided at an outer peripheral portion of the cutter head 12. A man lock 23 for exiting from the machine is provided in a front end portion of the excavating machine body 11, and a chemical liquid feed pipe 24 is provided in the outer peripheral portion of the excavating machine body 11.

A plurality of shield jacks 25 are arranged parallel in a circumferential direction in a rear portion of the excavating machine body 11. The shield jacks 25 are stretched rearward in an excavating direction and pressed against existing segments S, so that the excavating machine body 11, namely, the entire shield excavating machine, can be moved forward by a reaction force generated thereby. A ring girder 26 is formed in the rear portion of the excavating machine body 11, and a rest 28 extending rearward is fixed to a vertical beam 27 attached to the ring girder 26. A swivel ring 29 is pivotally supported by the ring girder 26, and an erector device 30 is mounted on the swivel ring 29. The erector device 30 can mount new segments S in a space between the excavating machine body 11 advanced by the shield jacks 25 and the existing segments S, and assemble the new segments S in a ring shape.

Furthermore, the rest 28 is provided with a segment assembly scaffold 31 for bolting the segments S assembled in the ring form by the erector device 30, and a shape retainer 32 for correcting the ring-shaped segments S into a predetermined shape (for example, a round shape) and retaining them in this shape.

Figure 2:
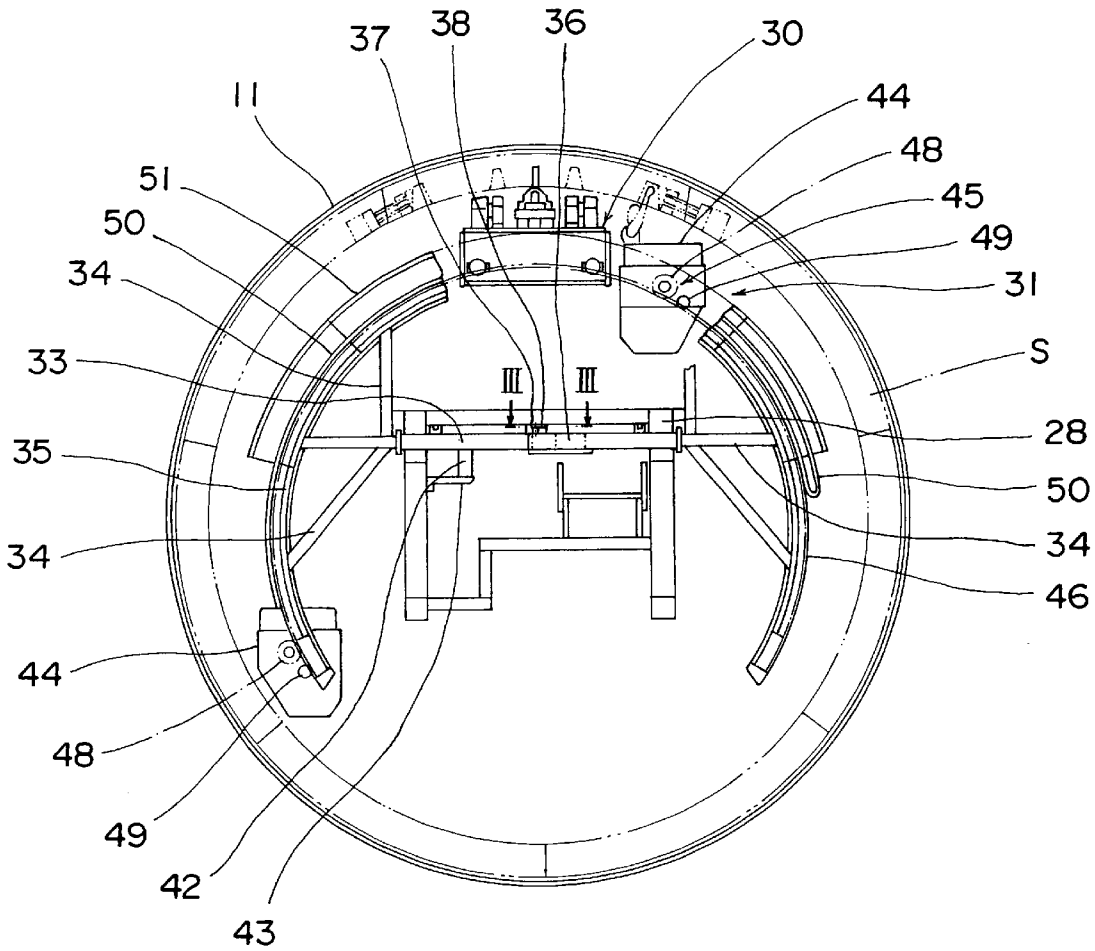
FIG. 2 is a front view of a segment assembly scaffold according to the first embodiment.
Figure 3:
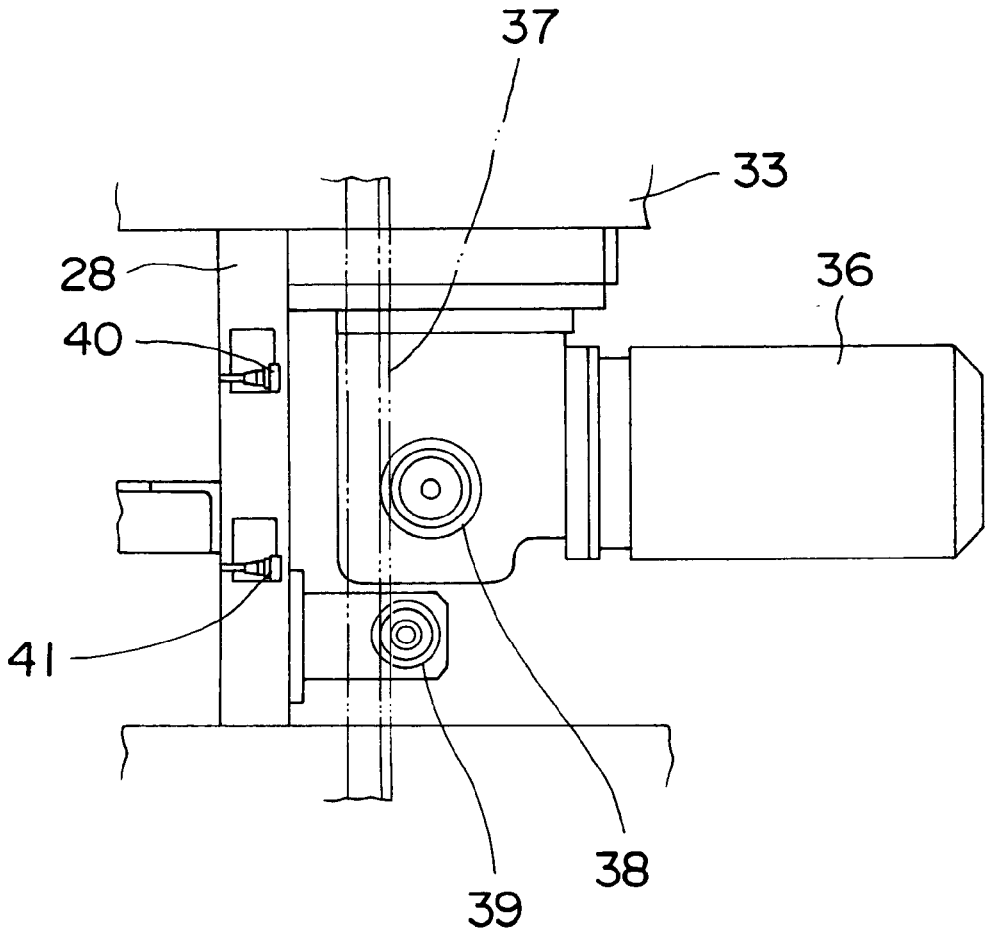
FIG. 3 is a sectional view taken on line III—III of FIG. 2 showing a slide mechanism for the segment assembly scaffold of the first embodiment.
Figure 4:
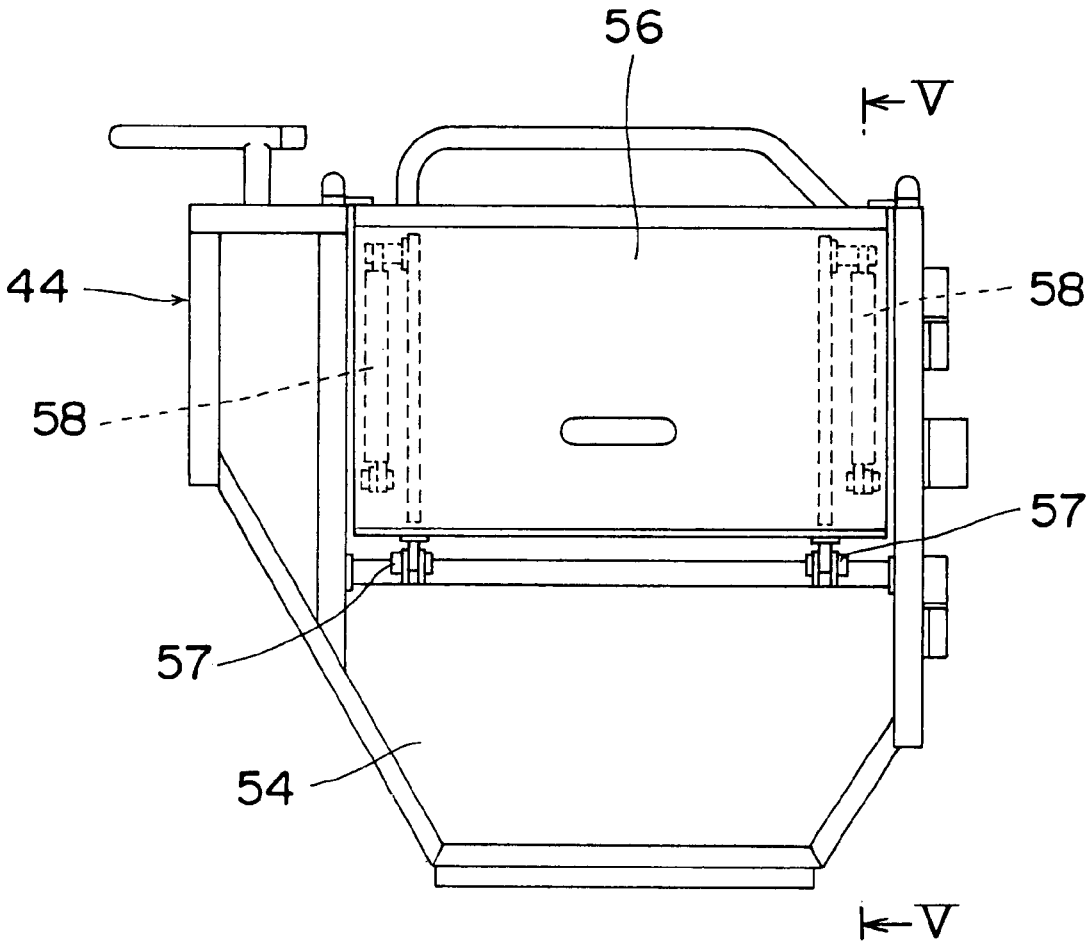
FIG. 4 is a front view of a cage.
Figure 5:
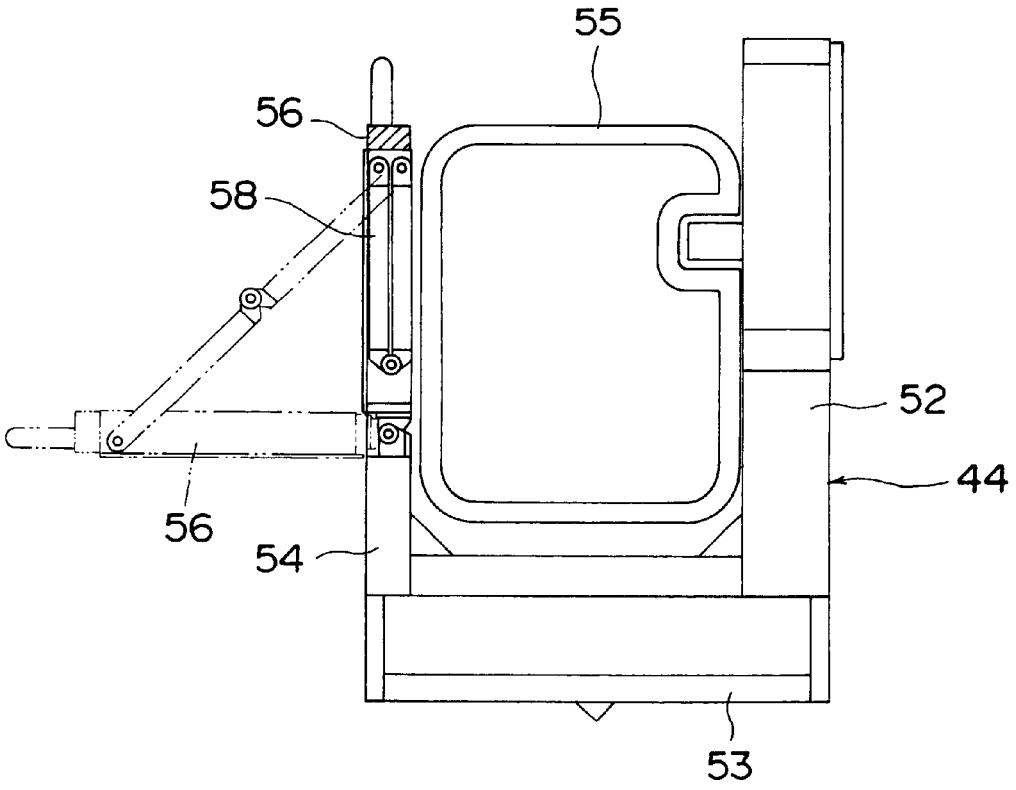
FIG. 5 is a sectional view taken on line V—V of FIG. 4.

In the segment assembly scaffold 31, as shown in FIGS. 1 to 3, a horizontally movable beam 33 located behind the erector device 30 is supported by the rest 28 so as to be movable along the fore-and-aft direction of the existing tunnel. A revolving frame 35 of a downward C-shape is attached to the horizontally movable beam 33 via a plurality of support beams 34. A drive motor 36 is mounted on the rest 28, while a rack 37 is fixed along the fore-and-aft direction to the horizontally movable beam 33, and a gear 38 of the drive motor 36 is in mesh with the rack 37. Thus, when the drive motor 36 is driven to rotate the drive gear 38, the revolving frame 35 can be moved along the fore-and-aft direction via the rack 37 and then via the horizontally movable beam 33. A sliding encoder 39, which engages the rack 37 and detects the moving position of the revolving frame 35, is mounted on the rest 28. Position sensors 40 and 41 for detecting the positions of forward movement and backward movement of the revolving frame 35 are also mounted on the rest 28. A cable guide 43, which supports a drive cable (a hydraulic hose or an electric cable) 42 connecting a drive source (not shown) loaded on the excavating machine body 11 to the drive motor 36, is attached to the underside of the horizontally movable beam 33.

Two cages 44, as working platforms, are supported by the revolving frame 35 so as to be movable by a drive mechanism 45, and these two cages 44 are symmetrical about the center of revolution and have the same structure. The drive mechanism 45 is constituted by a ring gear 46 provided along the outer periphery of the revolving frame 31, and a drive gear 48 of a drive motor 47 loaded on the cage 44, the drive gear 48 meshing with the ring gear 46. Thus, when the drive motor 47 is driven, the drive gear 48 rolls while meshing with the ring gear 46, whereby the cage 44 can be moved along the revolving frame 35. At this time, the cage 44 can be maintained in a horizontal state, no matter which position of the revolving frame 35 the cage 44 moves to. A revolving encoder 49 for detecting the moving position of the cage 44 is mounted on the cage 44. A cable guide 51, which supports a drive cable 50 connecting a drive source (not shown) loaded on the excavating machine body 11 to the cage 44, is attached to the outside of the revolving frame 35.

The cage 44 has a support wall 52 supported by the revolving frame 35, a bottom plate 53, and a front wall 54. An open/close door 55 is mounted on each side of the cage 44, and a working step 56 pivoting forward is provided on an upper portion of the front wall 54. The working step 56 has a lower end portion pivotably attached to the front wall 54 by support shafts 57, and is adapted to be positioned in a horizontal state by right and left link mechanisms 58.

In the shape retainer 32, as shown in FIG. 1, a horizontal rail 59 is attached onto the rest 28, and a support tube 60 is supported by the horizontal rail 59 so as to be movable forward and backward. An upper outer tube 61 and a lower outer tube 62 are fitted to the support tube 60 so as to be movable relative to each other, and an expansion jack 63 is interposed between the outer tubes 61 and 62. Arcuate pressurized contact members 64 and 65, which can be brought into pressurized contact with the inner surfaces of the segments S, are attached to the front ends of the upper and lower outer tubes 61 and 62, respectively. A moving jack 66 is mounted on the rest 28, and a drive rod 67 of the moving jack 66 is connected to the support tube 60.

Thus, the moving jack 66 is stretched to move the support tube 60 forward, thereby moving the pressurized contact members 64 and 65 to a position where they are opposed to the inner peripheral surfaces of the segments S which they are to hold. At this position, the expansion jack 63 is expanded to bring the pressurized contact members 64 and 65 into pressurized contact with the ring-shaped segments S via the upper and lower outer tubes 61 and 62. As a result, the segments S can be corrected to a predetermined shape and retained in this shape.

In the positional relationship among the erector device 30, the segment assembly scaffold 31 and the shape retainer 32 configured in the above-described manner, the segment assembly scaffold 31 moves back and forth, and can thereby be located within and outside the swivel or revolving range of the erector device 30. Nor does the shape retainer 32 interfere with the erector device 30 or the segment assembly scaffold 31, when the shape retainer 32 moves back and forth.

A tunnel excavating operation by the foregoing tunnel excavating machine will be described. As shown in FIGS. 1 and 2, when the shield jacks 25 are stretched with the cutter head 12 being rotated, the excavating machine body 11 is advanced by the reaction force imposed on the existing segments S, whereupon the cutter head 12 excavates the soil lying ahead, forming a tunnel. Then, the erector device 30 assembles segments S in a ring form to the inner wall surface of the resulting tunnel. In this state, the operator bolts the segments S to each other while standing on the segment assembly scaffold 31, and the shape retainer 32 corrects the segments S assembled in the ring form to a round shape and retains them in this shape.

Figure 6:
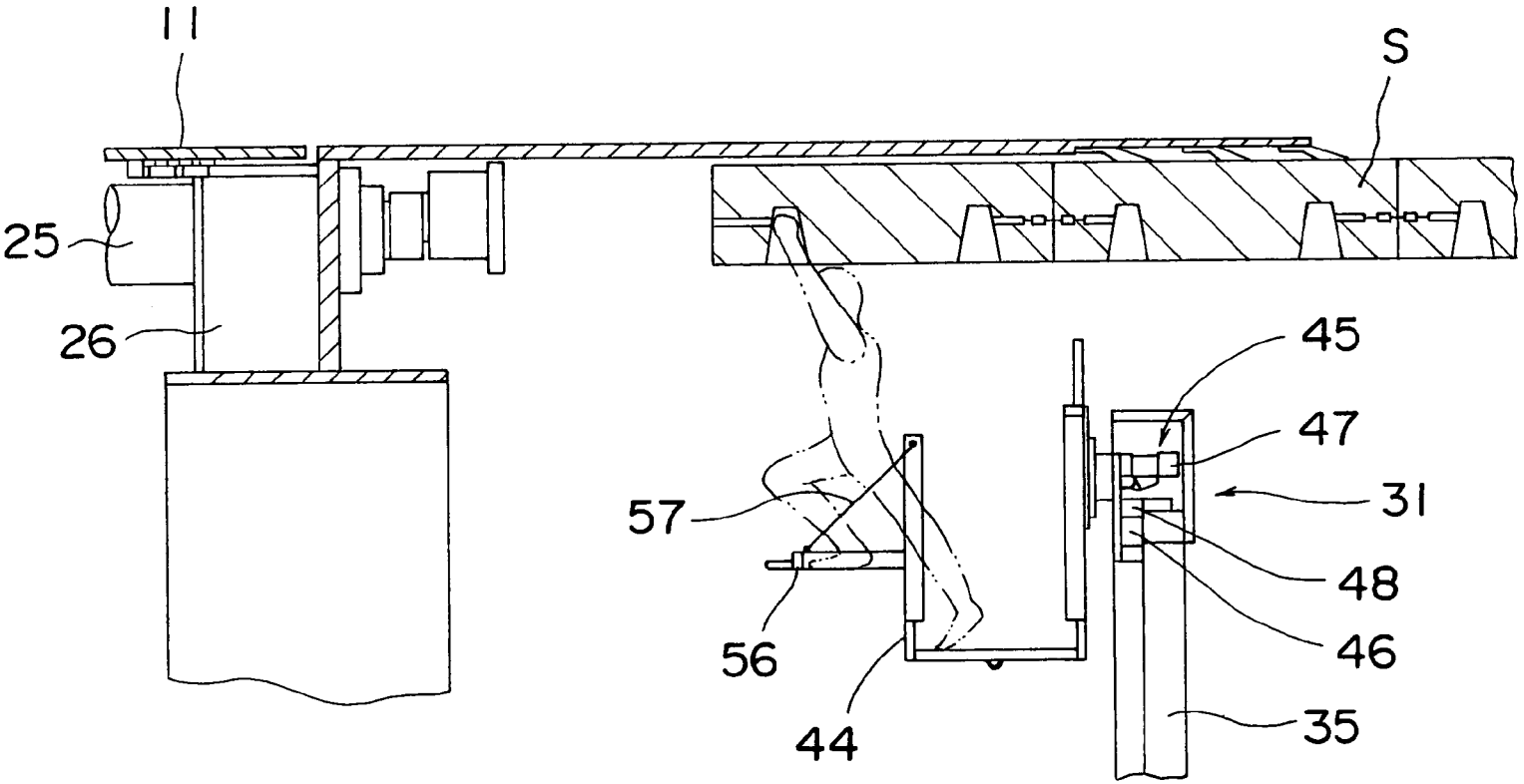
FIG. 6 is a schematic view of the segment assembly scaffold showing a bolting operation.

That is, the erector device 30 grasps the segments S carried into the existing tunnel, and assembles them sequentially to predetermined positions, starting at a lower position. The operator rides on the cage 44 of the segment assembly scaffold 31, and moves to the position of assembly of the segment S. At this position, the operator uses a predetermined tightening tool to perform a bolting operation for connecting and fixing the adjacent segments S. In this case, the cage 44 is moved forward, along with the revolving frame 35, by the drive motor 36 until the cage 44 is brought into the revolving range of the erector device 30, whereafter the cage 44 is moved circumferentially by the drive mechanism 45 until its approach to the erector device 30. As shown in FIG. 2, the operator bolts the circumferentially adjacent segments S while standing in the cage 44. As shown in FIG. 6, moreover, the operator also pivots the working step 56 of the cage 44 forward, gets on the working step 56, and clamps the segments S adjacent in the fore-and-aft direction by bolts.

The shape retainer 32 stretches the moving jack 66 to move the support tube 60 forward as far as a position, where the pressurized contact members 64 and 65 are opposed to the inner peripheral surfaces of the segments S, such that they do not interfere with the segment assembly scaffold 31. At this position, the expansion jack 63 is expanded to bring the pressurized contact members 64 and 65 into pressurized contact with the inner peripheral surfaces of the segments S, thereby correcting the segments S into a predetermined shape and retaining them in this shape.

According to the present embodiment, the erector device 30 is mounted in the rear portion of the excavating machine body 11, the rest 28 extends rearward, and the segment assembly scaffold 31 and the shape retainer 32 are supported on the rest 28 so as to be movable back and forth. Thus, the cage 44 can be brought close to the segment S assembled by the erector device 30, so that the operator can easily perform a bolting operation. Moreover, the working step 56 pivoting forward is provided in the cage 44. Thus, the operator can easily move forward with the use of the working step 56, and carry out a bolting operation.

[Second Embodiment]

Figure 7:
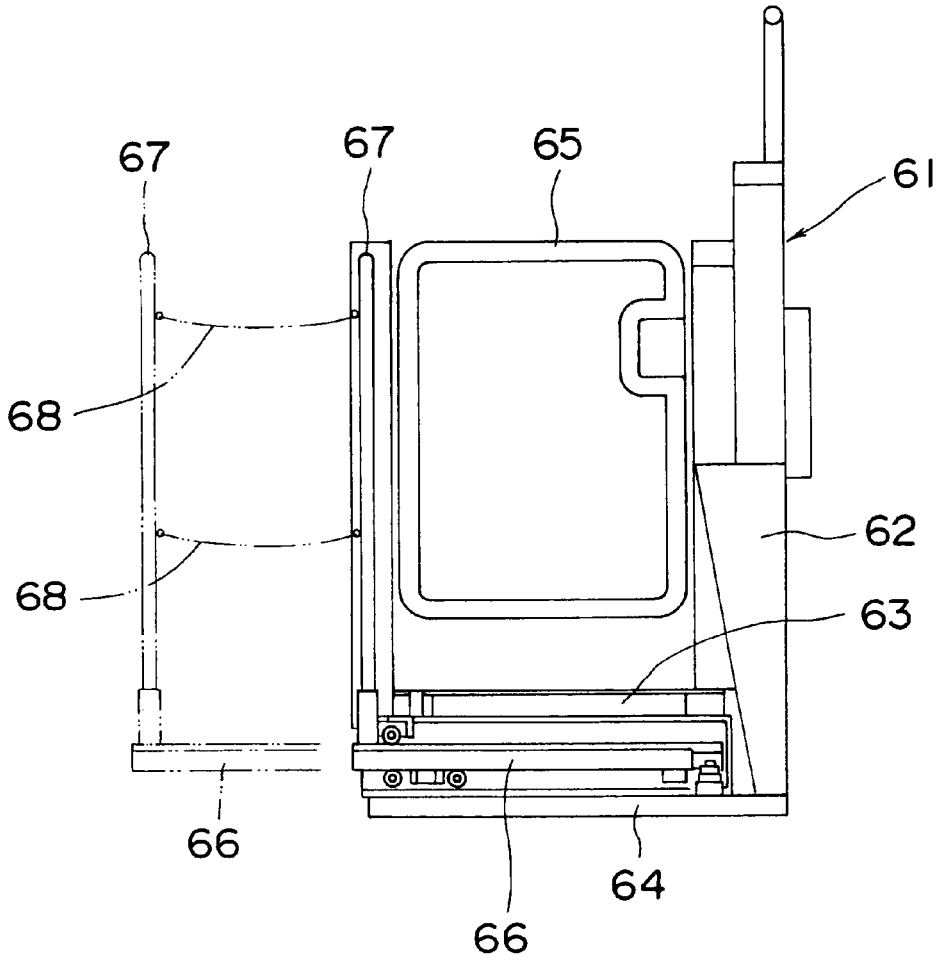
FIG. 7 is a side view of a cage applied to a tunnel excavating machine according to a second embodiment of the present invention.

In a tunnel excavating machine according to the present embodiment, as shown in FIG. 7, a cage 61 is constituted by having a support wall 62 supported by a revolving frame, double-bottom plates 63 and 64, and right and left open/close doors 65, providing a working step 66, which is slidable forward in a predetermined amount, between the double-bottom plates 63 and 64, and attaching a front wall 67 to a front portion of the working step 66. Right and left chains 68 are connected to the front wall 67 of the working step 66 so that the operator will not fall off when the working step 66 is moved forward.

Thus, when the erector device assembles the segment to a predetermined position, the cage 61 is moved forward and also moved in the circumferential direction until it approaches the erector device. The operator bolts the circumferentially adjacent segments from the cage 61, also slides the working step 66 of the cage 61 forward, stands thereon, and bolts the segments adjacent in the fore-and-aft direction.

[Third Embodiment]

Since a tunnel excavating machine according to the present embodiment has practically the same configuration as described in the aforementioned First Embodiment, its detailed description is omitted.

According to the present embodiment, as shown in FIG. 1, the cage 44 of the segment assembly scaffold 31 is automatically moved to a predetermined operating position, where the cage 44 is close to the segment held by the erector device 30, in a manner linked to a segment positioning action by the erector device 30 in a segment assembly operation by the aforementioned tunnel excavating machine.

Figure 8:
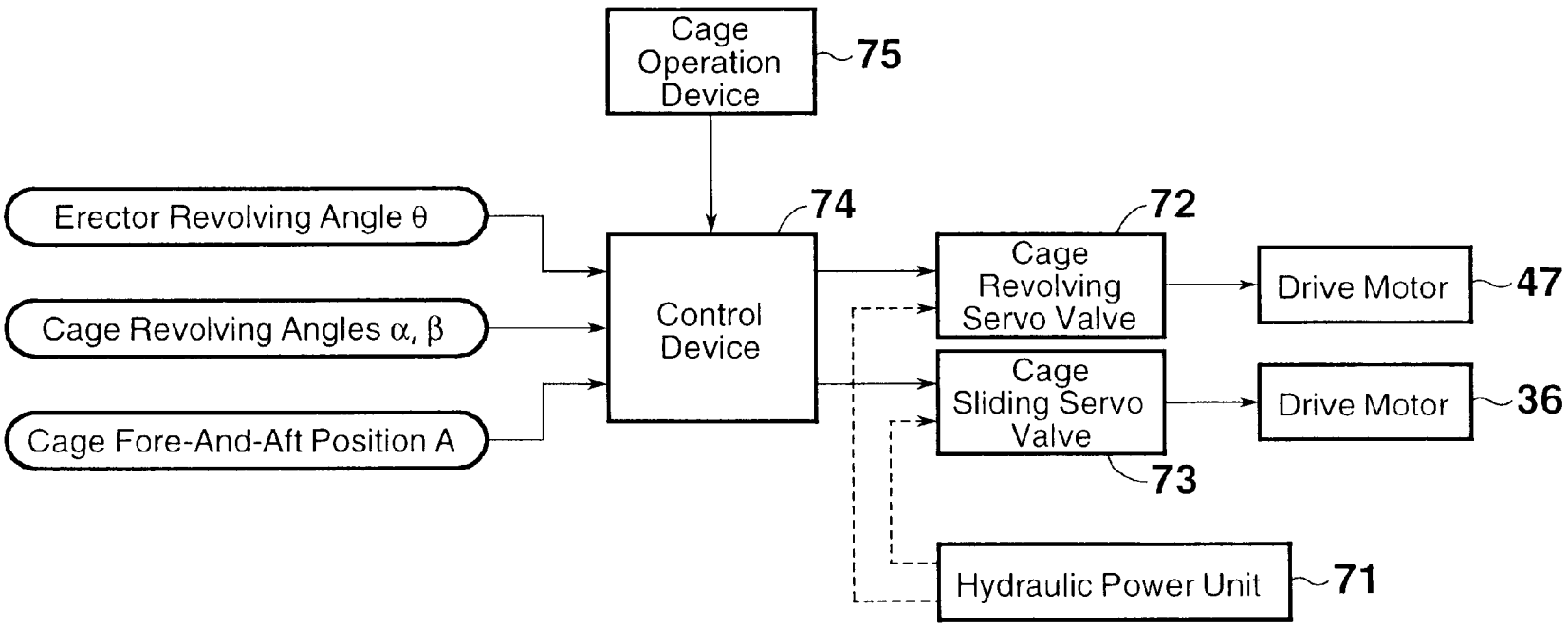
FIG. 8 is a block diagram of a segment assembly device applied to a tunnel excavating machine according to a third embodiment of the present invention.

That is, as shown in FIG. 8, the drive motor 47 for revolving the cage 44 in a circumferential direction via the revolving frame 35 is hydraulically actuated, and can be driven and controlled by regulating an oil pressure supplied from a power unit 71 by means of a servo valve 72. The drive motor 36, which slides the cage 44 in the fore-and-aft direction via the horizontally movable beam 33 and the revolving frame 35, is also hydraulically operated, and can be driven and controlled by regulating an oil pressure supplied from the power unit 71 by a servo valve 73. The servo valves 72 and 73 can be controlled by a control device (working platform control means) 74.

Figure 10:
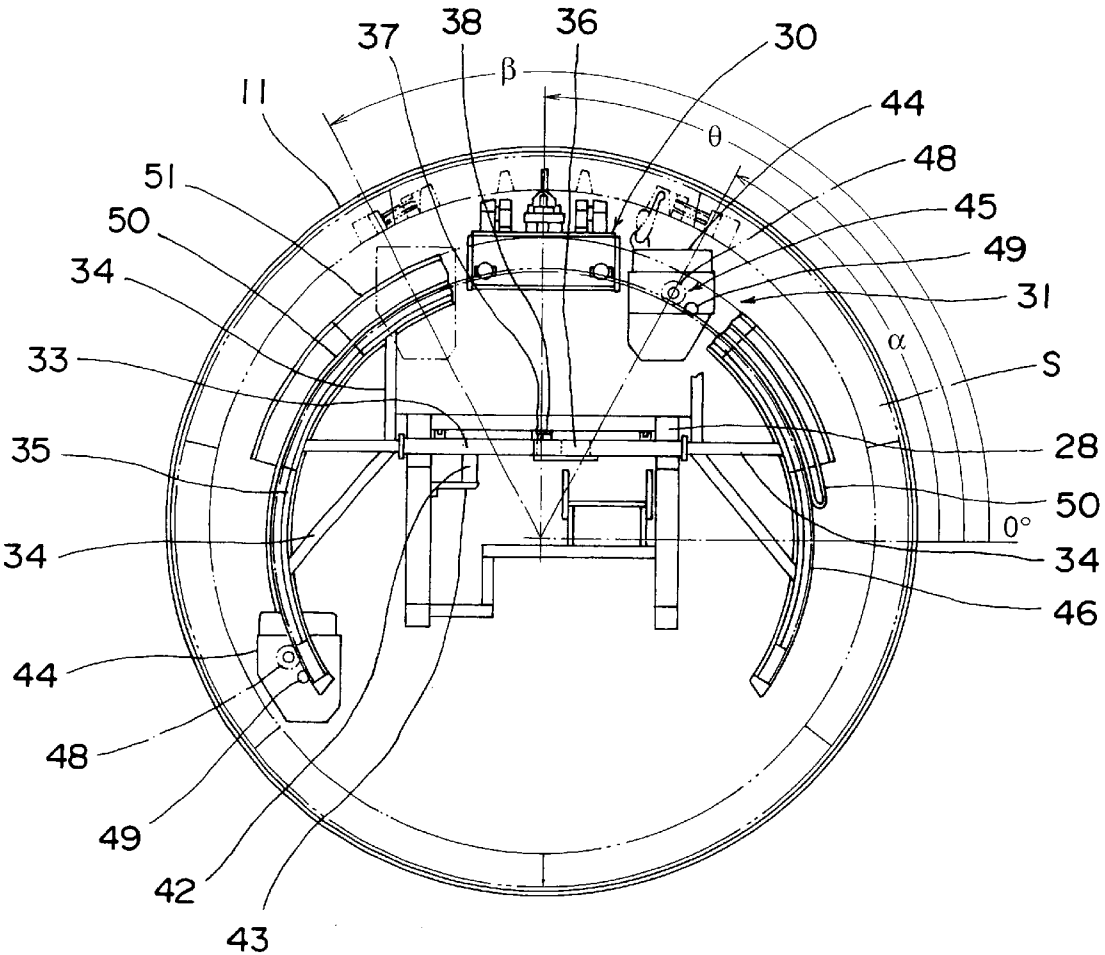
FIG. 10 is a front view of a segment assembly scaffold according to the third embodiment.

The control device 74 receives inputs about the revolving angle θ of the held segment S detected by a revolving encoder (not shown) loaded on the erector device 30, the revolving angles α and β of the cage 44 detected by the revolving encoders 49, and the position A in the fore-and-aft direction of the cage 44 detected by the sliding encoder 39. As shown in FIG. 10, the revolving angle θ of the erector device 30 is an angle from a horizontal reference position 0°, while the revolving angles α and β of the cage 44 are angles of revolution of the right and left cages 44*a* and 44*b* from the horizontal reference position 0°. A cage operating device 75 is connected to the control device 74, and the cage operating device 75 at least has a forward movement button, a backward movement button, a segment assembly position movement button, and a bolting position movement button.

Thus, at the time of a bolting operation for the segments S, the control device 74 sets the revolving angles α and β for moving the right and left cages 44*a* and 44*b* to the working position in accordance with the revolving angle θ of the erector device 30, and can drive the drive motors 47 and 36 via the servo valves 72 and 73 to move the cages 44*a* and 44*b* to the working position. In this case, the revolving angles α and β of the cages 44*a* and 44*b* are calculated by adding or subtracting preset given angles to or from the revolving angle θ of the erector device 30. The given angle to be added or subtracted has been set in accordance with the revolving angle θ, and its details are given in Table 1.

TABLE 1

| | Cage Revolving Angle | |
|---|---|---|
| Erector Revolving Angle | Cage 44a | Cage 44b |
| $0° < \theta \leqq 45°$ | $\alpha = \theta - 10°$ | $\beta = \theta + 10°$ |
| $45° < \theta \leqq 135°$ | $\alpha = \theta - 5°$ | $\beta = \theta + 5°$ |
| $135° < \theta \leqq 180°$ | $\alpha = \theta - 10°$ | $\beta = \theta + 10°$ |

The reason why the revolving angles α and β of the cages 44*a* and 44*b* are set in accordance with the revolving angle θ of the erector device 30, as described above, is as follows: The erector device 30 changes in posture according to the position of revolution, while the cages 44*a* and 44*b* are maintained in a horizontal state whatever positions of revolution they are located at. To prevent the interference of the erector device 30 and the cages 44*a*, 44*b*, the revolving angles α and β of the cages 44*a* and 44*b* and the revolving angle θ of the erector device 30 are not always different by a constant angle. By setting the revolving angles α and β of the cages 44*a* and 44*b* as shown in Table 1, the right and left cages 44*a* and 44*b* can be moved to the working positions where they are always located at constant distances from the erector device 30.

A tunnel constructing operation by the foregoing tunnel excavating machine will be described. As shown in FIGS. 1 and 10, when the shield jacks 25 are stretched with the cutter head 12 being rotated, the excavating machine body 11 is advanced by the reaction force imposed on the existing segments S, whereupon the cutter head 12 excavates the soil lying ahead, forming a tunnel. Then, the erector device 30 assembles segments S in a ring form to the inner wall surface of the resulting tunnel. In this state, the operator bolts the segments S to each other with the use of the segment assembly scaffold 31, and the shape retainer 32 corrects the segments S assembled in the ring form to a round shape and retains them in this shape.

Figure 9:
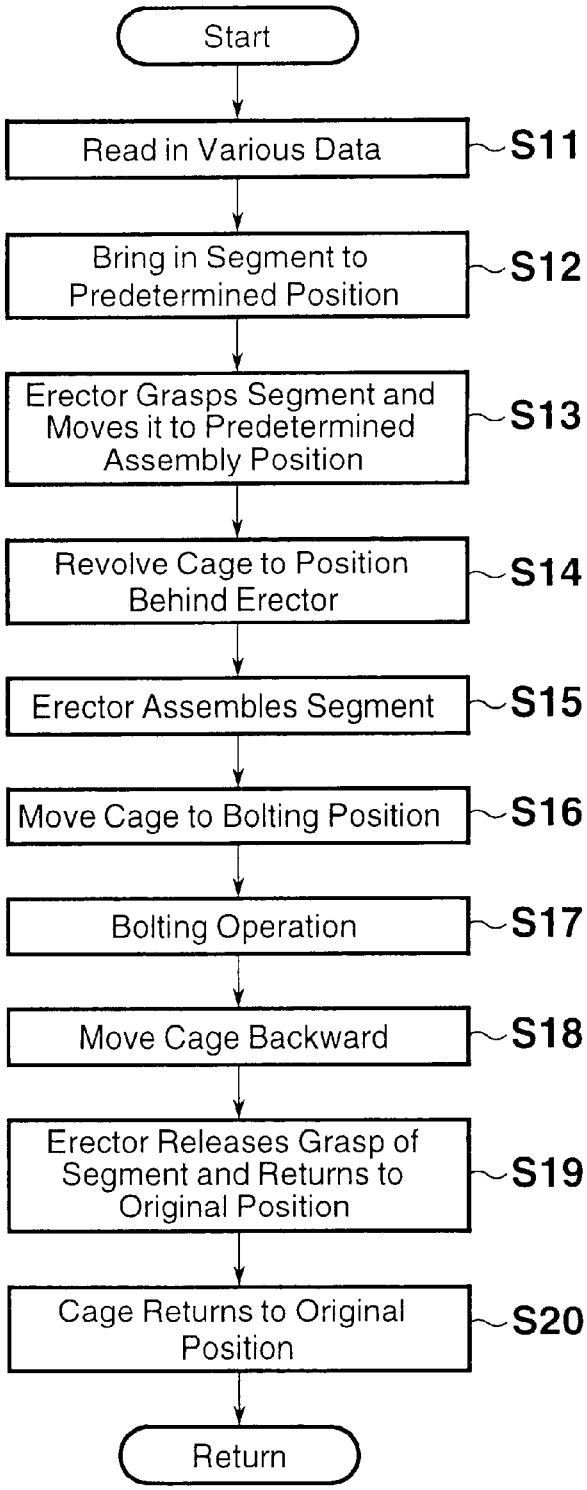
FIG. 9 is a flow chart for a segment assembly operation.

The segment assembly operation will be described in detail with reference to a flow chart in FIG. 9. In Step 11, the control device 74 reads in various data such as the revolving angle θ of the erector device 30, the revolving angles α and β of the cage 44, and the position A in the fore-and-aft direction of the cage 44. In Step S12, the segment S is conveyed into the existing tunnel with the use of a hoist (not shown), and placed at a predetermined position where the erector 30 can lift the segment S. In Step S13, the erector 30 grasps the segment S placed at the predetermined position, and moves the segment S to a predetermined assembly position by a raising or lowering action and a revolving action. In Step S14, the operator gets on the cage 44*a* of the segment assembly scaffold 31 moved backward out of the revolving range of the erector device 30, pushes the segment assembly position movement button of the cage operating device 75 to move the cage 44*a* to a space behind the segment S held by the erector 30, and stop the cage 44*a* there.

In Step S15, the operator on the cage 44*a* operates the erector 30 to make fine adjustment of the held segment S relative to the assembly position, and then advances and revolves the erector device 30 to move the segment S to a predetermined assembly position for positioning. In Step S16, the operator pushes the bolting position movement button, whereupon the control device 74 sets the revolving angles α and β for moving the cages 44*a* and 44*b* to the working position on the basis of the revolving angle θ of the erector device 30 by the aforementioned method, and drives the drive motors 47 and 36 via the servo valves 72 and 73 to move the cages 44*a* and 44*b* to working positions close to both sides of the erector device 30. That is, the cage 44*a* revolves in one direction from behind the held segment S, then moves forward into the revolving range of the erector device 30, revolves in the other direction, and stops at the working position. On the other hand, the cage 44*b* moves forward from the original position into the revolving range of the erector device 30, revolves, and stops at the working position. In Step S17, the operator on the cage 44*a* or 44*b* performs a bolting operation for connecting and fixing the adjacent segments S with the use of a predetermined tightening tool.

Upon completion of the bolting operation for the segments S by the operator, the backward movement button is pushed in Step S18 to bring the cage 44*b* rearward to the outside of the revolving range of the erector device 30. In Step S19, grasp of the segment S is released by the ascending or descending action and revolving action of the erector device 30, and the erector device 30 is returned to the original position. In Step S20, the cages 44*a* and 44*b* are returned to their original positions.

Then, the shape retainer 32 stretches the moving jack 66 to move the support tube 60 forward as far as a position, where the pressurized contact members 64 and 65 are opposed to the inner peripheral surfaces of the segments S, such that the pressurized contact members 64 and 65 do not interfere with the segment assembly scaffold 31. At this position, the expansion jack 63 is expanded to bring the pressurized contact members 64 and 65 into pressurized contact with the inner peripheral surfaces of the segments S, thereby correcting the segments S into a predetermined shape and retaining them in this shape.

According to the present embodiment, the erector device 30 is mounted in the rear portion of the excavating machine body 11, the rest 28 extends rearward, and the segment assembly scaffold 31 is supported on the rest 28 so as to be movable back and forth. During the bolting operation for the segments S, the revolving angles α and β of the cage 44 are set in accordance with the revolving angle θ of the erector device 30, and the cage 44 is moved to the predetermined working position with the push of the buttons. Thus, the cage 44 can be easily brought close to the segment S assembled by the erector 30 without interference with surrounding instruments, and the operator can easily perform the bolting operation.

In the above-described embodiment, setting of the revolving angles α and β of the cages 44*a* and 44*b* in accordance with the revolving angle θ of the erector device 30 is performed for three divided erector revolving regions. However, the highly accurate movement of the cages 44*a* and 44*b* can be achieved by providing more divided regions. Furthermore, the segments are used as the covering members, but a steel shell, formwork or timbering may be used as the covering members.

While the present invention has been described by the foregoing embodiment, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A tunnel excavating machine, comprising:

a cylindrical excavating machine body;

propulsion jacks for moving the cylindrical excavating machine body forward;

a cutter head rotatably mounted in a front portion of the excavating machine body;

an erector device mounted in a rear portion of the excavating machine body and adapted to assemble covering members in a ring form onto an inner wall surface of an existing tunnel;

a rest extending rearward from the rear portion of the excavating machine body;

a revolving frame located behind the erector device and supported on the rest so as to be movable along a fore-and-aft direction of the existing tunnel such that the revolving frame does not interfere with the erector device; and a working platform supported on the revolving frame so as to be revolvable in a circumferential direction of the existing tunnel.

2. The tunnel excavating machine of claim 1, wherein:

a shape retainer for making pressurized contact with inner peripheral surfaces of the covering members assembled onto the inner wall surface of the existing tunnel to retain the covering members in a predetermined shape is provided and supported on the rest so as to be movable along the fore-and-aft direction of the existing tunnel; and the revolving frame is located between the erector device and the shape retainer and supported on the rest so as not to interfere with the erector device and the shape retainer.

3. The tunnel excavating machine of claim 1, further comprising:

working platform revolving means for moving the working platform to a predetermined revolving position;

erector revolving position detection means for detecting a revolving position of the erector device; and working platform control means for setting a working position of the working platform adapted for the revolving position of the erector device and controlling the working platform revolving means.

4. The tunnel excavating machine of claim 3, wherein:

the working position of the working platform is at a revolving angle from a horizontal reference position; and the revolving angle is set by adding or subtracting a preset given angle to or from a revolving angle of the erector device from the horizontal reference position.

5. The tunnel excavating machine of claim 4, wherein:

the given angle has been set in accordance with the revolving angle of the erector device.

6. The tunnel excavating machine of claim 3, wherein:

the working platform is supported in a horizontal state regardless of the revolving position of the working platform; and the working platform control means sets the working position of the working platform, where the erector device and the working platform are close to each other at a constant distance, regardless of the revolving position of the erector device.

7. The tunnel excavating machine of claim 1, wherein:

the revolving frame is moved back and forth, whereby the working platform can be moved into and out of a revolving range of the erector device.

8. The tunnel excavating machine of claim 1, wherein:

the working platform control means is constituted such that an operation by an operator controls the working platform revolving means to move the working platform to the working position and stop the working platform at the working position.

9. The tunnel excavating machine of claim 1, wherein:

the working platform has a working step protruding forward.

10. The tunnel excavating machine of claim 9, wherein:

the working step is constituted by a front wall portion of the working platform pivoted forward.

11. The tunnel excavating machine of claim 9, wherein:

the working step is constituted by a bottom portion and a front wall portion of the working platform sliding forward.

* * * * *